US006109157A

United States Patent [19]

Talesky

[11] Patent Number: 6,109,157

[45] Date of Patent: Aug. 29, 2000

[54] ARBOR LOCKING MECHANISM

[75] Inventor: Mark S. Talesky, Chicago, Ill.

[73] Assignee: S-B Power Tool Company, Chicago, Ill.

[21] Appl. No.: 09/329,137

[22] Filed: Jun. 9, 1999

[51] Int. Cl.[7] ..... B26D 1/14; B27B 5/22; B27B 5/29

[52] U.S. Cl. ..... 83/666; 83/481; 83/665; 83/954; 83/DIG. 1; 83/477.2

[58] Field of Search ..... 83/DIG. 1, 954, 83/665, 666, 477.2, 481, 698.11, 698.41, 473, 477.1

[56] References Cited

U.S. PATENT DOCUMENTS

| | | | |
|---|---|---|---|
| 741,034 | 10/1903 | Hazelton | 83/477.2 |
| 4,145,940 | 3/1979 | Wolveke et al. | 83/666 X |
| 4,335,498 | 6/1982 | Hague et al. | 29/568 |
| 4,428,120 | 1/1984 | Kobayashi et al. | 83/666 X |
| 4,470,438 | 9/1984 | Obreanu et al. | 144/72 |
| 4,572,047 | 2/1986 | Punater et al. | 83/481 |
| 4,615,248 | 10/1986 | Erhard | 83/165 |
| 4,730,952 | 3/1988 | Wiley | 403/316 |
| 4,779,382 | 10/1988 | Rudolf et al. | 51/168 |
| 4,989,374 | 2/1991 | Rudolf et al. | 51/168 |
| 5,058,909 | 10/1991 | Rudolf et al. | 279/8 |
| 5,090,126 | 2/1992 | Higgins | 30/388 |
| 5,157,873 | 10/1992 | Rudolf et al. | 51/168 |
| 5,383,383 | 1/1995 | Garuglieri | 83/666 |
| 5,875,698 | 3/1999 | Ceroll et al. | 83/481 X |

*Primary Examiner*—M. Rachuba
*Assistant Examiner*—Boyer Ashley
*Attorney, Agent, or Firm*—Gardner, Carton & Douglas

[57] ABSTRACT

An arbor lock mechanism for use with an arbor of a table saw. The mechanism includes a bearing plate connected to the frame of the table saw and through which the arbor rotates. The mechanism also includes an arbor lock plate connected to the bearing plate and having an upper pivot hole, a central hole and a lower arcuate slot. The central hole includes a lower section through which the arbor extends and rotates and an upper section that has flat edges to secure the arbor in a locked position. The arbor lock plate includes lift portion to move the plate between an open position, where the arbor rotates, and a locked position that secures the arbor.

11 Claims, 5 Drawing Sheets

ARBOR LOCKING MECHANISM

BACKGROUND OF THE INVENTION

1. Field of the Invention

The present invention relates to a table saw and in particular, to a locking mechanism to lock an arbor of the table saw while a blade is added to or removed from the arbor.

2. Scope of the Prior Art

Table saws use rotating blades to cut various substances, most particularly wood. As such, table saws typically include an outer frame portion that has an upper surface on which the wood or other materials can be placed and moved along as it is cut by the blade. The upper resting surface of the table saw has an opening through which the cutting blade passes. Depending upon the size of the opening, the opening can be enclosed with a plate that includes a slot through which the blade passes.

Table saws also include motors that are used to rotate the blade at the necessary speed to cut the wood or other substance. The table saw motor is supported by the frame in any number of known methods. The table saw can also include a bearing plate that is connected proximate the slot to the underside of the upper surface. Thus, the bearing plate is positioned between the motor and the blade.

In order to turn the blade, the motor, rotates an arbor, spindle, output shaft or mandrel. The term arbor will be used to include spindle, output shaft, or mandrel. The arbor has a first end that is connected by the motor. At the second and distal end, the blade of the table saw is removably attached. In those embodiments that include a bearing plate, the bearing plate includes a hole through which the arbor passes. The bearing plate hole is large enough so that the arbor can rotate freely within that hole.

Typically, the blade is held by a nut against a shelf formed on the arbor. In order to secure the blade and the nut to the arbor, a user typically uses two wrenches. The first wrench is used to hold the rotatable arbor in a stationary position, and the second arbor is used to rotate the nut against or away from the blade. Various different methods are used to ensure that the nut is tightened with sufficient torque thereby securing the blade to the arbor for correct use of the table saw.

The use of two wrenches to secure the blade to the arbor can be difficult and awkward. In addition, the method is not conducive to ensure that the nut is tightened to the correct torque because of the counter-balance turning of the two wrenches. Accordingly, it is needed to develop an arbor locking mechanism that can lock the arbor in position while the blade is being secured to the arbor. In addition, the arbor locking mechanism must be easy to use and easy to access through the opening in the upper surface of the frame.

Arbor locking plates are commonly used in other types of power tools such as routers. The use of the arbor locking plates on these tools are different from the present invention because of the size of both the tool and the rotating arbor on the tool. The size of the tool and the arbor make it often necessary for the tool to include a simple arbor lock mechanism to attach a working implement to the arbor. In addition, the design of such routers can make it difficult to reach the arbor lock mechanism thereby requiring the tool's frame or casing to be disassembled to access the arbor locking plate.

Arbor locking plates have also been used on table saws. Such arbor lock plates include a pivot point that attaches the arbor lock plate to the frame of the saw. The arbor lock plate also includes a large slot through which the arbor of the table saw passes. The large slot is on the opposing end of the arbor plate from the pivot point and has a large lower section and a smaller upper section. The arbor can rotate freely through the large lower section and locks the arbor in a stationary position in the smaller upper section. The arbor can be configured with a portion having flat opposing edges and where the flat opposing edges are placed within the slot. In this configuration, the smaller upper portion engages the flat opposing edges of the arbor thereby locking the arbor. Accordingly, a blade can be secured or removed from the arbor.

SUMMARY OF THE INVENTION

The present invention is an arbor lock mechanism that is used to lock the arbor of a table saw in a secured position so that a blade can be added to and removed from the arbor with ease. The arbor lock mechanism of the present invention improves on the prior art because it easy to operate, and it is designed to withstand the forces of use. It also is more stable because of how it is connected to the table saw. In addition, the arbor lock mechanism has improved configuration to provide a smoother operation as the mechanism is used to add and remove blades. Furthermore, the present invention is easily accessible.

The table saw that is a part of the present invention includes a frame that has an upper surface on which a substance, such as wood, can be supported while it is being cut. The upper surface of the frame includes an opening through which the blade that cuts the wood can extend. The height of the blade through the slot can also be adjusted. In the preferred embodiment of the present invention, a plate, also including a slot, can be placed in the opening of the upper surface so that the open space surrounding a rotating blade is minimized. The table saw also includes a motor to rotate the blade. The motor is supported by the frame in any known arrangements.

In order to rotate the blade for cutting, the table saw includes an arbor in the form of a shaft that has two ends. The first end is connected to the motor in such a way that the motor rotates the arbor along its longitudinal axis. The second and distal end extends from the motor so that that end is placed in the vicinity of the opening in the upper surface. When the blade is placed on the arbor's distal end, the blade extends through the opening in the upper surface. The arbor also includes a portion between the first and second ends that has opposing flat edges.

The present invention includes a bearing plate that is connected to the frame of the saw such that it is proximate to the opening and the second end of the arbor. The bearing plate has a hole passing through a part of the plate so that the arbor can extend through the hole. The hole is sized so that the arbor can freely rotate. The bearing plate is preferably positioned towards the underside of the upper surface and proximate the slot in that surface. In the preferred embodiment, the bearing plate includes a contoured indent on its upper edge, which is easily accessible from the slot.

The arbor lock plate of the present invention includes a lower arcuate slot, a central slot and an upper bolt hole. Extending from the edge towards the upper bolt hole, the preferred embodiment includes a lift portion that has a cantilevered lift tab extending from the distal end. In the preferred embodiment, the central slot has a double-D-shape with an upper portion having opposing flat edges and the lower portion having rounded edges. The arbor lock plate is pivotally secured to the bearing plate by a shoulder screw passing through the upper hole and a shoulder screw passing through the lower arcuate slot such that that bolt and shoulder screw are secured to the bearing plate. The arbor is placed through the central slot so that the arbor plate surrounds the arbor's flat edge portion. In the preferred embodiment, a torsion spring can be placed around the pivot point shoulder screw and secured to the arbor plate.

In operation, the arbor plate is biased in a first position by the torsion spring. In the first position, the arbor passes through the low-rounded edge portion so that the arbor can freely rotate within the hole of the bearing plate and the arbor plate. In order to add or remove a blade from the arbor, a user pulls the lift tab to move the arbor plate from the first position to the second position. As the arbor plate is moved, it pivots about the top shoulder screw and the bottom shoulder screw moves through the lower arcuate slot. As the arbor plate pivots, the flat-edged portion of the arbor passes from the lower rounded-edge of the central slot to the upper flat-edged portion of the central slot. As the upper portion engages the arbor, the flat edges of the slot align with the flat edges of the arbor to secure the arbor in a locked position whereby the arbor will not rotate. When the arbor is locked in this way, a single wrench can be used to tighten or loosen the nut thereby adding or removing the blade to the arbor. When that operation is complete, the lift portion is released and the torsion spring returns the plate to the first position so that the arbor can rotate.

These and numerous other features and advantages of the present invention will become readily apparent from the following description, the accompanying drawings and the appended claims.

DETAILED DESCRIPTION OF THE PREFERRED EMBODIMENT

Figure 1:
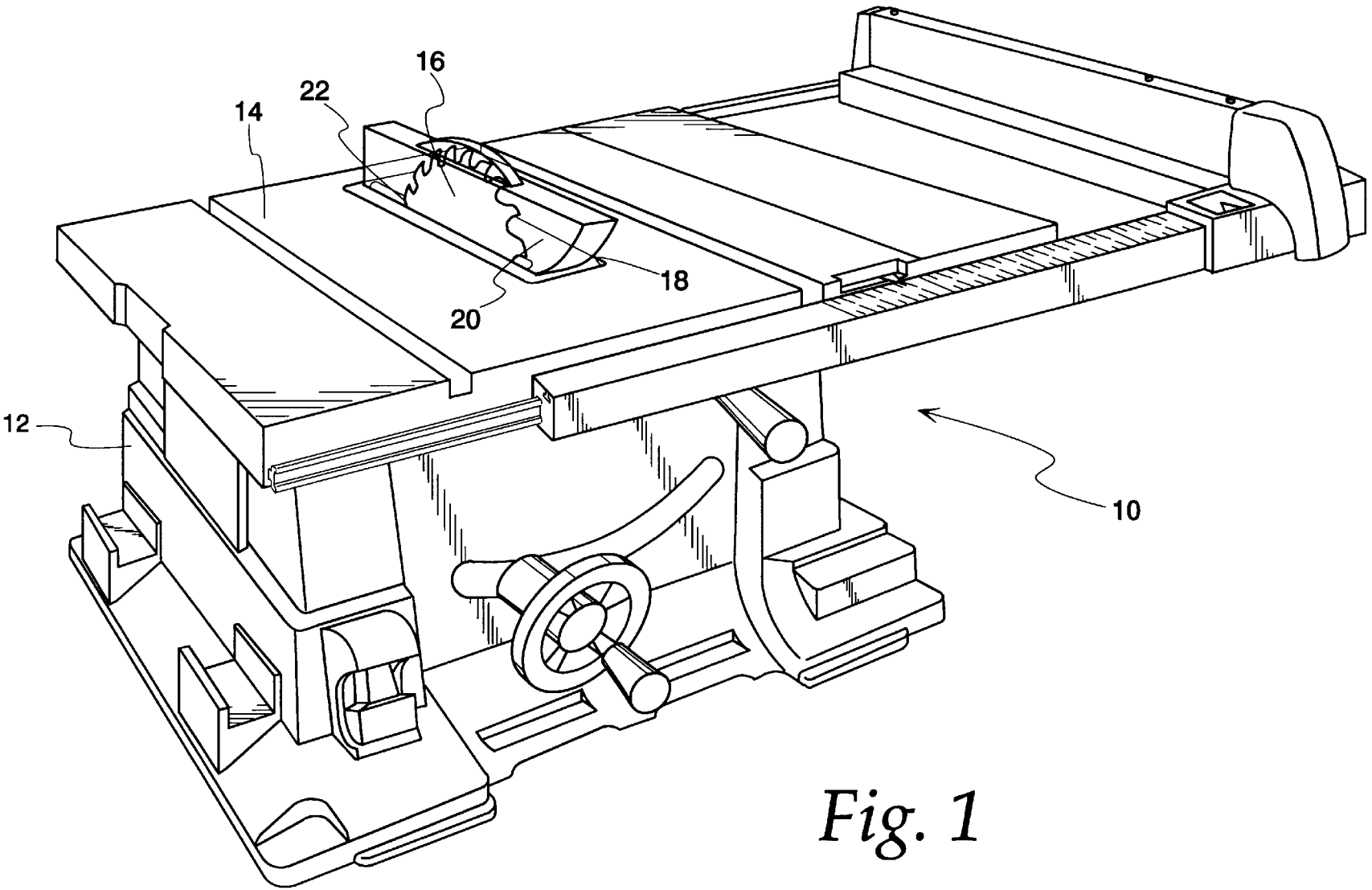
FIG. 1 illustrates a table saw that incorporates the arbor lock mechanism of the present invention.

FIG. 1 illustrates a table saw 10 that incorporates the arbor lock mechanism made in accordance with the principles of the present invention. The table saw 10 includes a frame 12 and an upper cutting surface 14 on which a substance, such as wood, is placed to be cut by a blade 16. As seen, the blade 16 extends through an opening 18 in the upper cutting surface 14. In the preferred embodiment, the opening 18 is closed by a plate 20 that includes a slot 22. The slot is sufficiently large to provide enough clearance for the blade 16 to rotate. As known to those skilled in the art, table saw 10 includes a motor (not shown) that rotates the blade 16 at sufficient speed so that the blade cuts substance.

The present invention includes an arbor lock mechanism 30 of the type shown in FIGS. 2–6. The purpose of the arbor lock mechanism is to function with the arbor 32 of the table saw. One end of the arbor is connected to the table saw's motor so that the arbor can be rotated at the appropriate speed for cutting. The blade 16 is connected to the other end of the arbor 32. As seen in the Figures, the arbor has a generally round cross section, although it is known in the art that other cross-sectional shapes can be used. For the present invention, the arbor has a section 34 proximate the blade connecting end. The cross-sectional area of section 34 is greater than that of the arbor 32 such that the section 34 creates a shelf 36 proximate the end of the arbor. When the blade 16 is connected to the arbor, the blade 16 can rest against the shelf 36. The section also includes at least two opposing flat surfaces 38 that are generally parallel to the longitudinal axis of the arbor 32 and the section 34.

Figure 2:
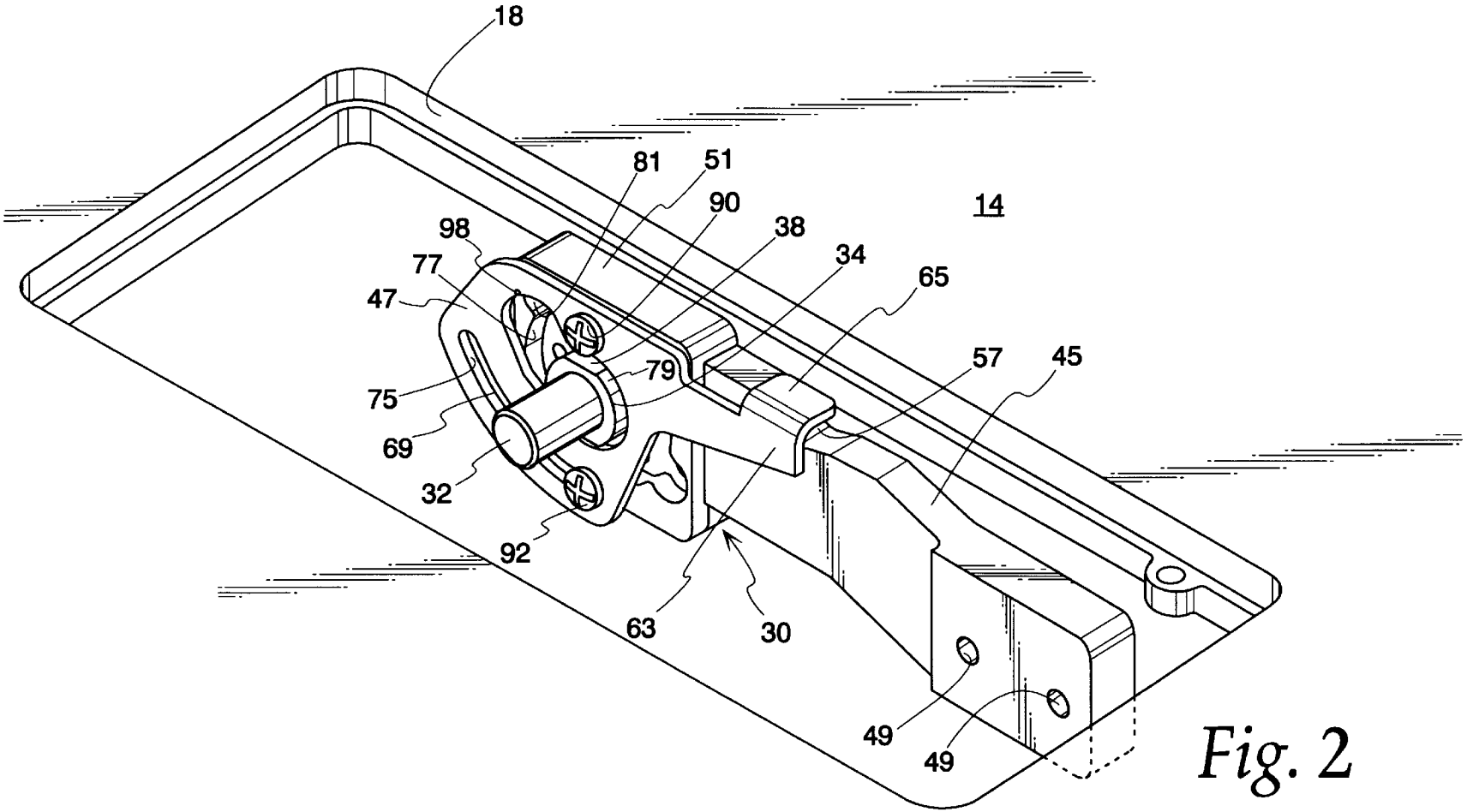
FIG. 2 illustrates a perspective view of the upper cutting surface of the table saw that incorporates the arbor lock mechanism of the present invention where the arbor lock mechanism is in an open position.
Figure 3:
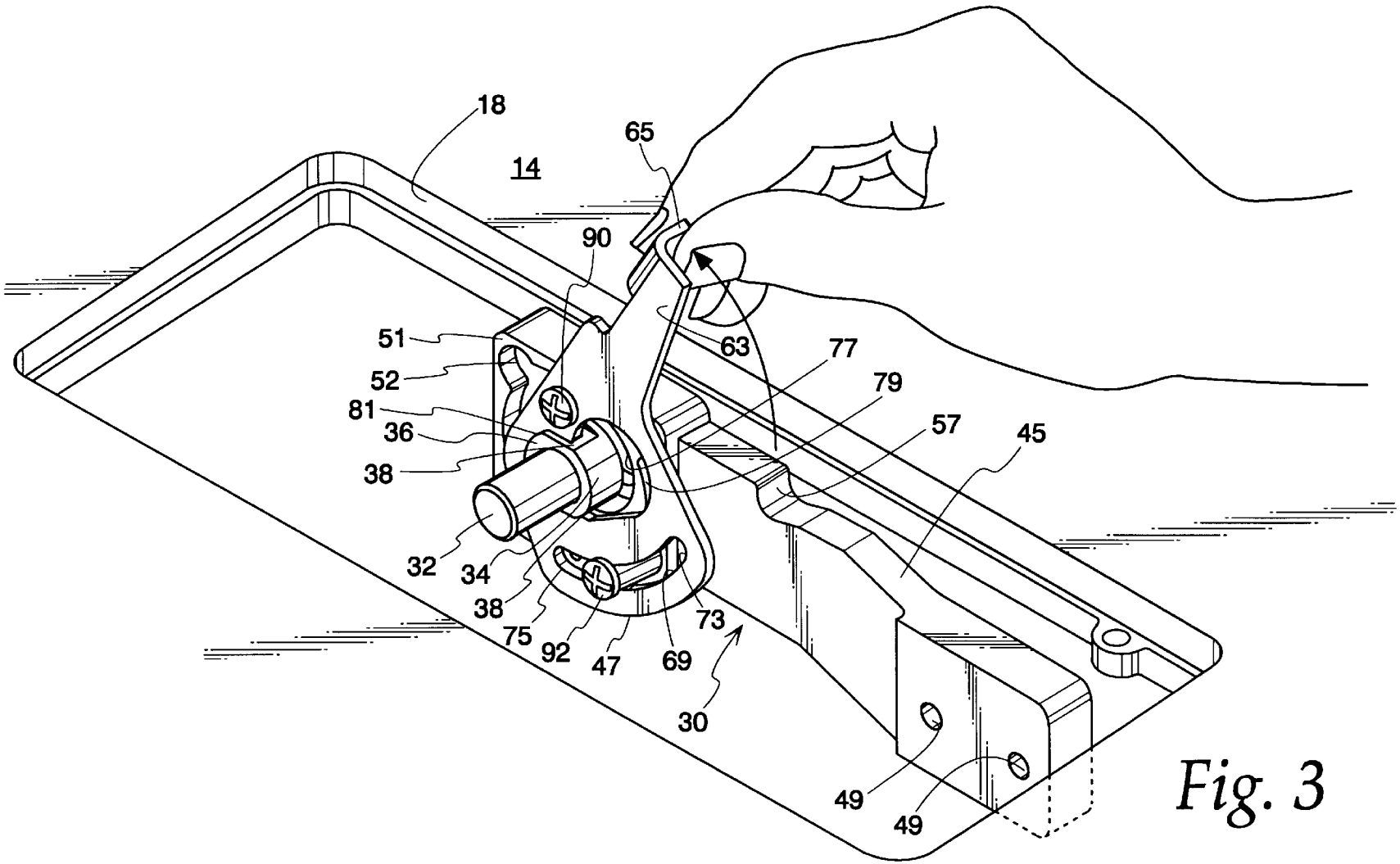
FIG. 3 illustrates a perspective view of the arbor lock mechanism as it moved into the locked position.
Figure 4:
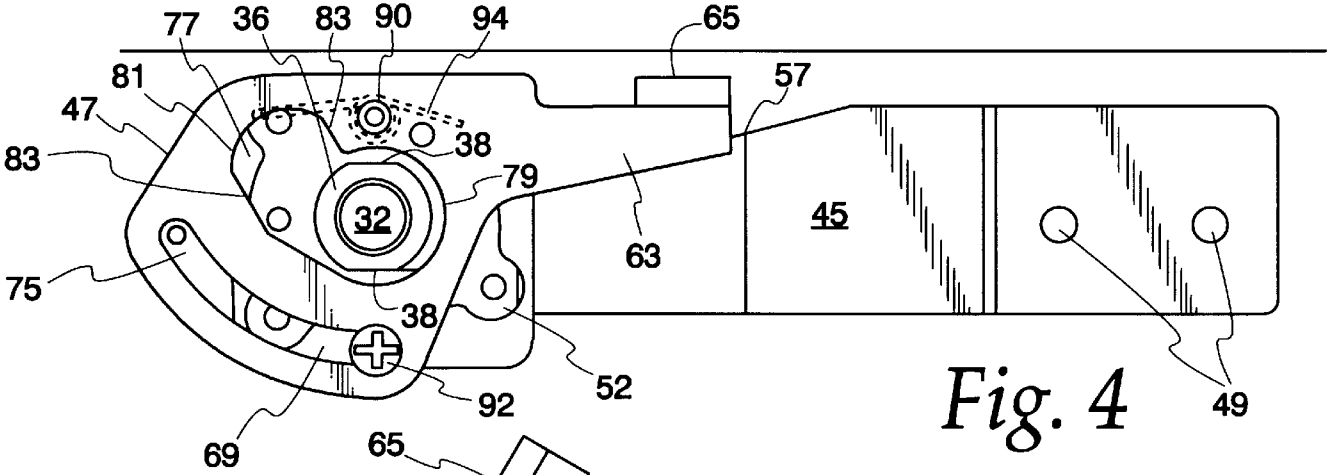
FIG. 4 illustrates a side view of the arbor lock mechanism when the arbor lock plate is in open position.
Figure 5:
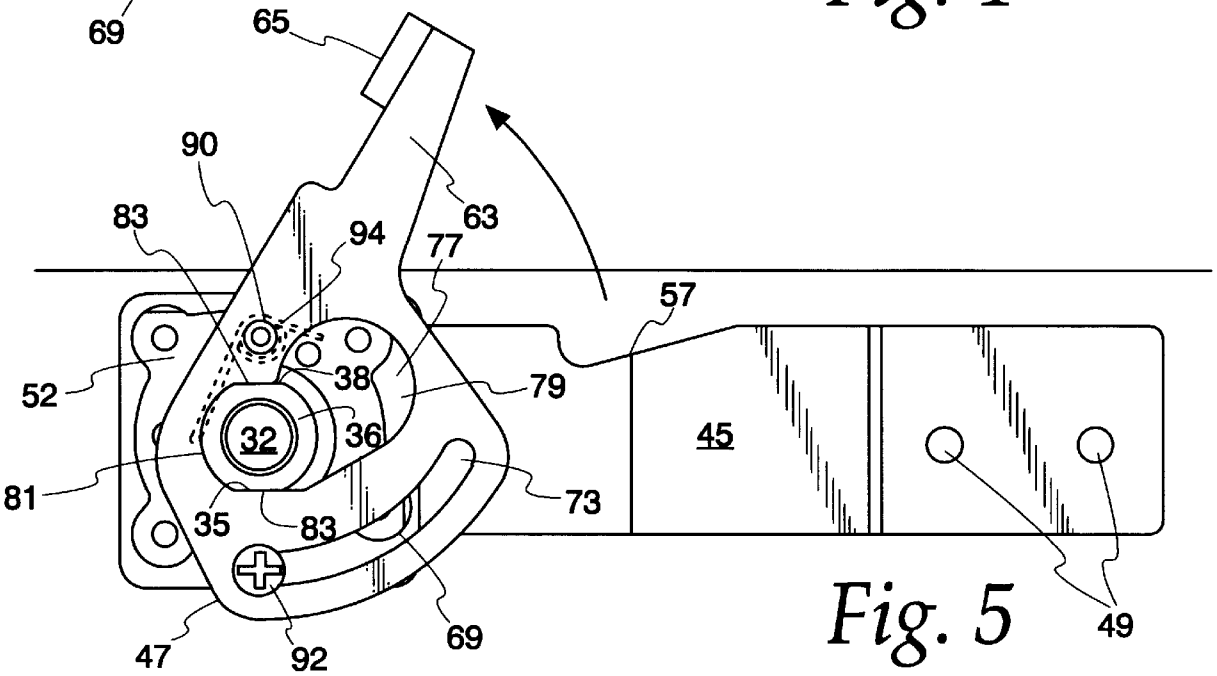
FIG. 5 illustrates a side view of the arbor lock mechanism when the arbor lock plate is in the locked position.

The arbor lock mechanism 30 of the present invention includes a bearing plate 45 and an arbor lock plate 47. The bearing plate includes a series of holes 49 through which bolts can be used to connect the bearing plate 45 to the frame 12. As seen in FIGS. 2 and 3, the bearing plate 45 connected to the frame 12 such that it is adjacent the opening 18 in the upper cutting surface 14. The bearing plate 45 can also be configured to connected to the underside of the upper cutting surface 14. According to the foregoing, the arbor lock mechanism 30 is easily accessible when the plate 20 is removed from the upper cutting surface 14.

The bearing plate 45 has a generally elongated shape with one end 51 having a square shape. The square end includes a cavity section 52. At the center of the cavity, a large central hole 53 is positioned. Above the central hole 53, a smaller hole 54 is positioned on tower 55. Below the central hole, a smaller hole 56 is also positioned. In view of the size of the central hole 53, the arbor 32 extends therethrough such that the arbor 32, including the section 34 can freely rotate. Along the upper edge, the bearing plate 32 also includes a contoured indent 57, which will be described in more detail below.

The arbor lock plate 47 includes a main body section 59 having an upper edge 60, and an opposing lower edge 61. The arbor lock plate 47 also includes a lifting portion 63 which extends from one of the edges between the upper and lower edges 60, 61. At the distal end of the lifting portion 63, a cantilevered tab 65 extends perpendicularly.

In the main body section 59, a pivot hole 67 is positioned towards the upper edge 59. Proximate the opposing lower edge 61, the main body section 59 includes an arcuate slot 69 having a first end 73 and a second end 75. A central slot 77 having a double-D-shape is located in the main body 59 between the upper pivot hole 67 and the lower arcuate slot 69.

To configure the double-D-shape, the central slot 77 has a lower section 79 with rounded edges. The lower section 79 is aligned over the arcuate slot's first end 73. The central slot 71 also has an upper section 81 with opposing flat edges 83. The upper section 81 is aligned over the arcuate slot's second end 75. The shape of the first and second sections 79 and 81 gives the central slot 77 a somewhat arcuate shape.

As seen in the Figures, the arbor lock plate 47 is pivotally connected to the bearing plate 45 by a shoulder screw 90, or other suitable mechanism, that screws through pivot hole 67 and into a hole 54 in the bearing plate 45. In addition, a shoulder screw 92 is used to pivotally screw the arbor lock plate to the bearing plate. The shoulder screw 92 passes through the lower arcuate slot 69 and into the hole 56 in the bearing plate 45. In this arrangement, the arbor 32 extends through the central slot 77 so that the section 34 is positioned within that central slot 77. The lower section 79 is sized so that the arbor 37 rotates freely within the central slot 77 thereby turning the blade 16. The arbor lock plate 47 is arranged on the bearing plate 45 such that the lifting portion 63 extend towards the end opposing the square end. In the preferred embodiment, the cantilevered tab 65 is positioned to align with contoured indent 57.

Figure 6:
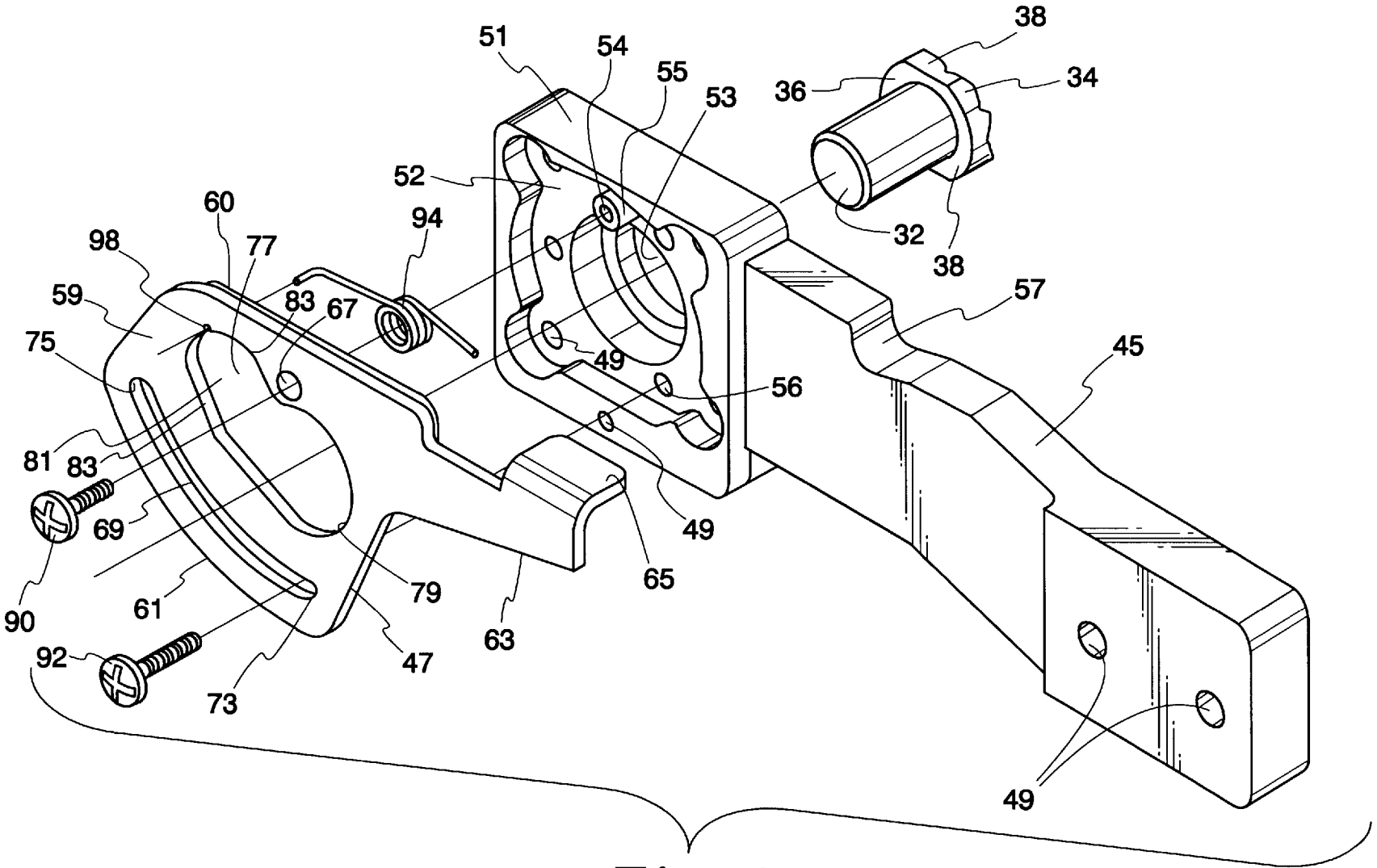
FIG. 6 illustrates an exploded view of the arbor lock mechanism of the present invention.

The arbor lock mechanism 30 of the present invention can be configured with a spring 94. As seen in FIG. 6, the spring is arranged to fit over tower 55 in cavity section 52 of the bearing plate 45. One end of spring 94 abuts against the wall of the cavity section 52, and the opposing end is connected within the central slot 77. The central slot 77 can be configured with a notch 98 for the opposing end of spring 84. The spring is arranged within the cavity 96 and the central slot 77 such that the spring 94 biases the arbor lock plate with the cantilevered tab 65 adjacent the contoured indent 57.

The spring 94 biases the arbor lock plate 47 into a first position. In the first position, the cantilevered tab 65 is adjacent the contoured indent 57. In the first position the arbor's section 34 is positioned in the first section 79 and the shoulder screw 92 is towards the first end 73 of the lower arcuate slot 69. The motor can, therefore, freely rotate the arbor 32. The blade 16 therefore can cut the substance that is being pushed across the upper cutting surface 14.

When the blade 16 needs to be removed from or added to the arbor 32, the plate 20 is removed from the upper surface 14, therefore exposing the arbor lock mechanism 30 through the opening 18. The arbor lock plate 47 moves from the first and open position to a second and locked position by pulling up on the lifting portion 63. The contoured indent 57 provides a space so that a finger can reach under the cantilevered tab 65 to pull up on the lifting portion 63. As the lifting portion is pulled up, the arbor lock plate 47 pivots about the shoulder screw 90 and the pivot hole 67. The shoulder screw 92 also moves through the arcuate slot 69 from the first end 73 towards the second end 75. In addition, the arbor 32 moves from the lower section 79 with its rounded edges, to the upper section 81. As the arbor 32 moves into the upper section 81, the flat opposing edges 83 engage with the flat edges 36 of section 34. The distance between the opposing flat edges 83 is slightly larger than the distance between the flat-edges 36 on the arbor 32. Accordingly, the arbor 32 fits into the second section 81 such that the second section locks the arbor and prevents the arbor from rotating.

While holding the lifting portion in the second and locked position, a table saw user can remove or add a blade 16 to the arbor 32 with only one wrench to attach the bolt to the arbor 32. After the blade 16 is removed or added, the user releases the lifting portion 63 and the spring 94 returns the arbor lock plate 47 to the first and open position. The flat edges 83 of the upper section 81 will disengage from the flat edges 36 of section 36, and the arbor 32 returns to the first section. The arbor can therefore freely rotate.

The configuration of the pivot hole, central hole and arcuate slot on the arbor lock plate provide, at least in part, ease of use of the present invention. The ease of use is also improved by the design of the lift portion and cantilevered tab as well as the contoured indent formed in the bearing plate. In addition, the configuration of the present invention stabilizes the arbor lock plate against the bearing plate, allows the arbor plate to move smoothly between the open and locked position, and will not deteriorate the components after many uses.

Although the present invention has been described in considerable detail with reference to certain preferred versions, other versions are possible. Therefore, the spirit and scope of the appended claims should not be limited to the description of the preferred embodiment described.

What is claimed is:

1. A table saw having an arbor lock mechanism, the table saw comprising:

a frame including an upper surface having an opening and a bearing plate proximate the opening, a motor supported by the frame;

an arbor having a first and second end and having a section with opposing flat outer surfaces between the ends wherein the motor rotates the arbor at the first end;

a saw blade removably connected to the arbor at the second end so that the blade extends through the opening and wherein the arbor rotates the saw blade to cut a substance; and an arbor lock plate having a lower arcuate slot, a central double-D-shaped slot having a rounded-edge portion and a flat-edge portion, an upper bolt hole, and a lifting portion wherein the arbor lock plate is pivotally connected to the bearing plate by an upper shoulder screw passing through the upper bolt hole and a lower shoulder screw passing through the lower arcuate slot such that the flat outer surfaces of the arbor are within the double-D-shaped slot, wherein the arbor lock plate pivots around the upper shoulder screw by pulling on the lift portion such that the lower shoulder screw slides through the arcuate slot from a first position in which the arbor rotates in the rounded-edge portion and a second position in which the flat outer surfaces of the arbor are locked in the flat-edge portion of the central double-D-shaped slot, and, a bolt to secure the saw blade to the arbor.

2. The table saw according to claim 1 wherein the bearing plate has an indent to access the lifting portion.

3. The table saw according to claim 1 further comprising a torsion spring connected between the arbor lock plate and the bearing plate to bias the arbor lock plate in the first position.

4. An arbor lock mechanism for use with a table saw having a rotating arbor comprising:

a bearing plate member secured to the table saw, wherein the bearing plate member has a hole through which the arbor passes, an arbor lock plate having an arcuate slot, a central slot and an upper hole, wherein a first shoulder screw connects the arbor lock plate to the bearing plate member through the upper hole and a second shoulder screw connects the arbor lock plate to the bearing plate member through the arcuate slot such that the arbor passes through the central slot and the arbor lock plate pivots about the first shoulder screw while the second shoulder screw passes through the arcuate slot between a first position where the arbor freely rotates and a second position that locks the arbor, and wherein the arbor has a section with opposing flat edges and the central slot has a double-D-shape comprising a lower round-edge portion through which the arbor rotates and an upper flat-edged portion to engage the flat edges of the arbor to lock the arbor in the second position.

5. The arbor lock mechanism according to claim 4 further comprising a torsion spring biasing the arbor lock plate in the first position.

6. The arbor lock mechanism according to claim 4 wherein the arbor lock plate further comprising a lift portion extending from an upper edge of the plate to facilitate pivoting the plate from the first position to the second position.

7. The arbor lock mechanism according to claim 6 wherein the lift portion includes a cantilevered tab.

8. The arbor lock mechanism according to claim 6 wherein the bearing plate member comprising a finger-contoured portion to access the lift portion.

9. An arbor lock mechanism for use with a table saw having a rotating arbor, the arbor lock mechanism comprising:

a bearing plate member secured to the table saw; and an arbor lock plate, wherein the arbor lock plate comprises an upper hole;

a lower arcuate slot;

a central slot; and a lift portion extending along an edge proximate the upper hole and having a cantilevered lift tab at a distal end wherein the lift tab corresponds in location to a contour indent for access to the lift portion;

a first shoulder screw passing through the upper hole to pivotally mount the arbor lock plate to the bearing plate member; and a second shoulder screw passing through the lower arcuate slot and connecting to the bearing plate member such that the arbor lock plate moves over said second shoulder screw as the arbor lock plate pivots about said first shoulder screw; and wherein the arbor lock plate pivots between a first position where the arbor rotates within the central slot and a second position where the central slot locks the arbor by pulling on the lift tab.

10. The arbor lock mechanism according to claim 9 wherein the arbor having a section with opposing flat edges and the central slot having a double-D-shape comprising a lower round-edge portion through which the arbor rotates in the first position and an upper flat-edged portion having opposing flat edges to engage the flat edges of the arbor to lock the arbor in the second position.

11. The arbor lock mechanism according to claim 9 further comprising a torsion spring biasing the arbor lock plate in the first position.

* * * * *